US007261254B2

(12) United States Patent
Mindler

(10) Patent No.: US 7,261,254 B2
(45) Date of Patent: Aug. 28, 2007

(54) SELF-REGULATING MEDIA HOLDER

(75) Inventor: Robert F. Mindler, Churchville, NY (US)

(73) Assignee: Eastman Kodak Company, Rochester, KY (US)

( * ) Notice: Subject to any disclaimer, the term of this patent is extended or adjusted under 35 U.S.C. 154(b) by 44 days.

(21) Appl. No.: 11/020,908

(22) Filed: Dec. 22, 2004

(65) Prior Publication Data

US 2006/0131460 A1 Jun. 22, 2006

(51) Int. Cl.
*B65H 49/26* (2006.01)

(52) U.S. Cl. ..... 242/597.3; 400/703

(58) Field of Classification Search ..... 242/597, 242/597.1, 597.2, 597.3, 597.5, 571.4, 580, 242/573, 573.1, 573.9; 492/9, 47; 29/407.09, 29/407.1, 895.22; 116/200, 281–283; 400/703
See application file for complete search history.

(56) References Cited

U.S. PATENT DOCUMENTS 3,275,257 A * 9/1966 Cherniavskyj ..... 242/611.2
3,799,465 A * 3/1974 Erny ..... 242/597.3
3,944,153 A * 3/1976 Linker ..... 242/597.3
6,109,801 A * 8/2000 Mabit ..... 400/242
6,623,193 B1 * 9/2003 Holland ..... 400/242
6,997,629 B2 * 2/2006 Bungert et al. ..... 400/613
2004/0022572 A1 * 2/2004 Bungert et al. ..... 400/248

OTHER PUBLICATIONS

Shinko Electric Company, CHC-S7045 printer handle guide.

* cited by examiner

*Primary Examiner*—Patrick Mackey
*Assistant Examiner*—William E. Dondero

(57) ABSTRACT

A holder for a rolled medium is provided. The holder has a mandrel having a drive surface adapted to receive the rolled medium and is adapted to be rotated so that an amount of rolled medium on the drive surface can be unrolled therefrom. A stop is located on a stop end of the drive surface. A retaining surface is located on a load end of the drive surface and is separated from the stop so that a rolled medium can be disposed therebetween with the retaining surface being movable between a first position where the retaining surface projects above the drive surface and a second position where the retaining surface does not project above the drive surface. A resilient biasing structure is joined to the retaining surface to drive the retaining surface toward the first position and the drive surface drives the rolled media toward the stop.

23 Claims, 6 Drawing Sheets

SELF-REGULATING MEDIA HOLDER

FIELD OF THE INVENTION

The present invention relates media holders for roll stored media such as paper, fabric, film, thermal donor media and thermal receiver media of the type that are used in home and commercial printers.

BACKGROUND OF THE INVENTION

Thermal printers are becoming an increasingly popular form of commercial and home printing. Such printers require precise alignment of media relative to a printing head throughout a printing operation. However, as media is driven through a thermal printing operation, a possibility arises that the lateral location of the medium on the holder will be adjusted and that registration problems can arise. Even minor registration problems can create unacceptable image artifacts in an image formed by a thermal printer. Accordingly, what is needed is a low cost mechanism to ensure that rolled mediums such as thermal donor or receiver mediums maintain a constant position on during printing operations. Similar considerations arise in other forms of rolled medium printing.

One approach to solve this problem is found in the Shinko Electric Company's model CHC-S7045 printer. In this printer, a holder assembly has a first flange that is retained to a spring-loaded steel shaft and a second removable flange that is located at a fixed position on a threaded end of the steel shaft using a wing nut, which is also threaded onto the shaft. Once the wing nut is unthreaded, the removable flange can be slid off of the steel shaft allowing rolled media to be placed over the steel shaft and interface with the spring-loaded flange remaining on the shaft. The removable flange is re-installed over the steel shaft and the wing nut is threaded onto the steel shaft. The wing nut to removable flange is then tightened to a prefixed location with regard to the edge of the steel shaft creating a fixed dimension from the end of the shaft to the inside flange of the removable flange to thereby constrain the rolled medium.

It will be appreciated, however, and that such approach requires manual threading and provides a fixed structure that is expensive and time consuming to load.

Thus, what is needed is a low cost system for retaining rolled medium on a mandrel that allows quick replacement of the rolled medium and that provides dynamic constraints to the control the positioning of the rolled medium. What is also needed is an effective and inexpensive system for warning a user when a medium is not located properly thereon.

SUMMARY OF THE INVENTION

In one aspect of the invention, a holder for rolled medium is provided. The holder has a mandrel with a drive surface adapted to receive the rolled medium and adapted to be rotated so that an amount of rolled medium on the drive surface can be unrolled therefrom. A stop is located on a stop end of the drive surface. A retaining surface is located on a load end of the drive surface and is separated from the stop so that a rolled medium can be disposed therebetween with the retaining surface being movable between a first position where the retaining surface projects above the drive surface and a second position where the retaining surface does not project above the drive surface. A resilient biasing structure is joined to the retaining surface and is elastically deformable, with the biasing structure storing potential energy when the retaining surface is driven to the second position and releasing the stored potential energy to urge the retaining surface to move to the first position. The retaining surface is positioned to engage a rolled medium positioned on the drive surface at a position between the first position and the second position and is shaped to transfer a portion of the stored potential energy in the resilient biasing structure to drive the rolled media toward the stop.

In another aspect of the invention, a holder for rolled media is provided. The holder has a mandrel defining a drive surface, the drive surface having a spring finger formed at a load edge thereof with the spring finger having a retaining surface extending outwardly from the drive surface when the spring finger positions the drive surface in a first position. The spring finger being elastically deformable from the first position to a second position wherein the retaining surface is positioned so that it does not extend outwardly from the drive surface. The spring finger is biased to move the retaining surface towards the first position. A stop is positioned at a stop end of the mandrel with the stop to block rolled media on the drive surface from lateral movement along the mandrel toward the stop end. The retaining surface is defined so that when the rolled media is loaded on the mandrel to a position proximate to the stop, the retaining surface engages the rolled media with the spring finger at a position between the first position and a second position, so that a portion of the force biasing the retaining surface from the second position to the first position is applied to drive the rolled media toward the stop.

In yet another aspect of the invention, a holder for a rolled medium is provided. The holder has a rolled medium drive surface for receiving the rolled medium; a stop means at a first end of the rolled medium drive surface and a retaining means at a second end of the drive surface. The retaining means is separated from the stop means by a distance defined by a width of the rolled medium, the retaining means being movable between a first position where the retaining means projects above the drive surface and a second position where the retaining means does not project above the contact surface. A biasing means is provided for biasing the retaining means from the second position to the first position. The retaining means has a translation means for converting the biasing from the biasing means into a force applied to urge the rolled medium toward the stop means.

DETAILED DESCRIPTION OF THE INVENTION

Figure 1:
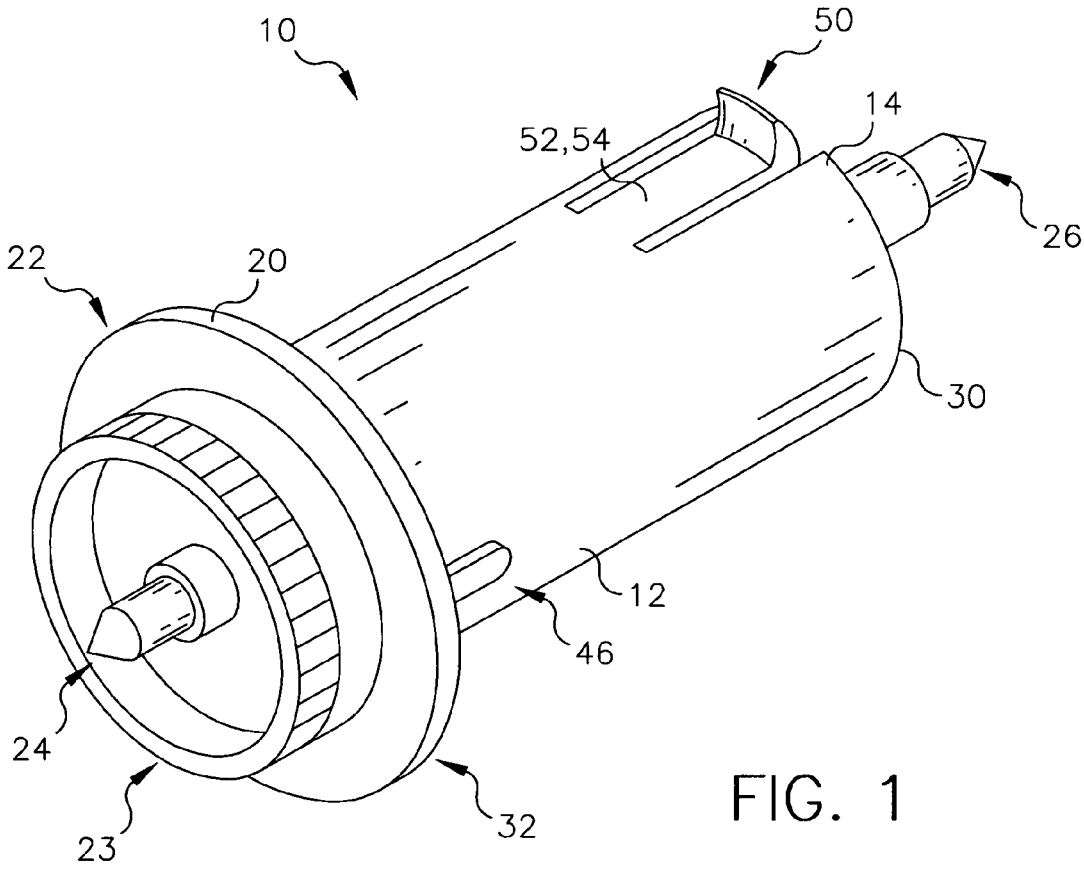
FIG. 1 illustrates a perspective view of a first embodiment of a holder of the present invention.
Figure 2:
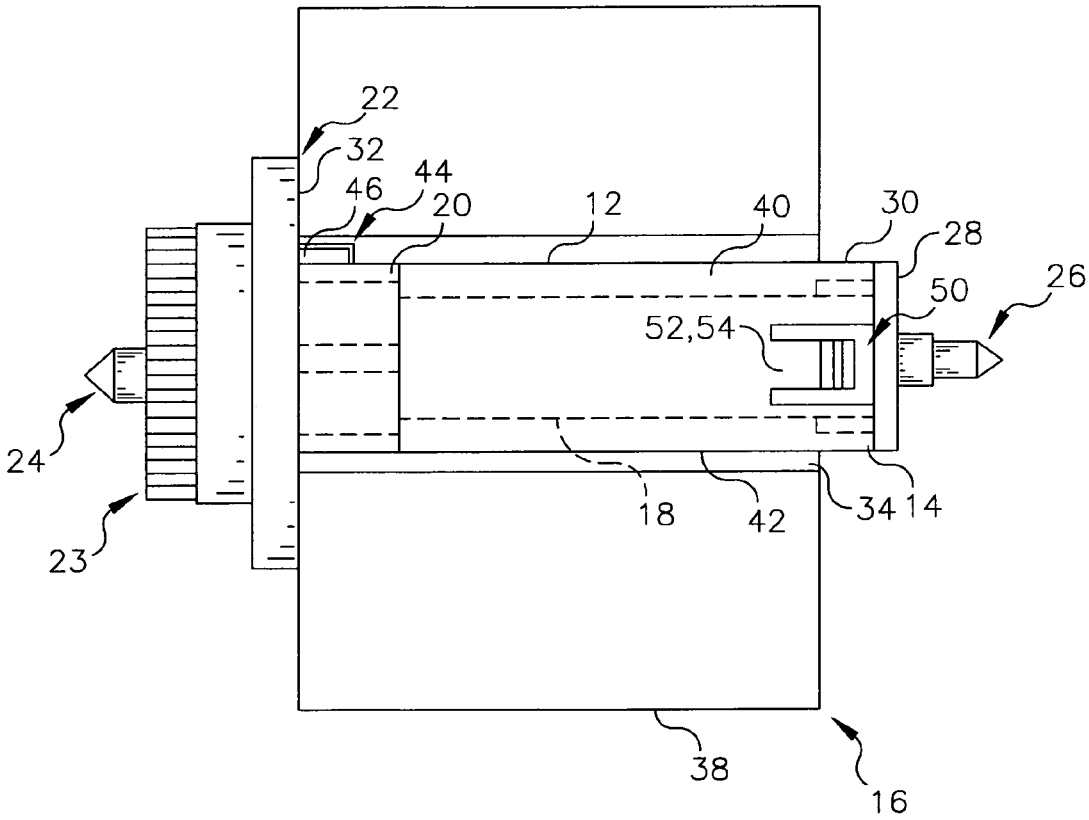
FIG. 2 illustrates a side section view of the embodiment of FIG. 1.

In the embodiment illustrated in FIGS. 1 and 2, cylindrical mandrel 14 has an inner chamber 40. As is shown in FIG. 2, chamber 18 is capped at a stop end 20 by a drive end cap 22. Drive end cap 22 also has a stop end axle 24 that is aligned with a load end axle 26 on a load end cap 28 that is joined to cylindrical mandrel 14 at a load end 30 to provide pivot points to define an axis of rotation for cylindrical mandrel 14. In the embodiment of FIG. 1, drive end cap 22 has an optional assembly drive gear 23 located thereon. Assembly drive gear 23 is adapted to receive co-designed gears of a drive system (not shown) within a printer (not shown) into which holder 10 is placed so that a driving force can be applied to cause cylindrical mandrel 14 and drive surface 12 to rotate about the axis of rotation. Drive end cap 22 also defines a stop surface 32 that is shaped to confront a rolled medium 16 that is inserted on to cylindrical mandrel 14 to limit axial movement of the rolled medium 16 toward stop end 20.

Rolled medium 16 is typically provided in the form of a cylindrical core 34 having an outer surface 36 about which a medium 38 is wound. Medium 38 can comprise any form of material that can be used to donate or receive any type of material that can be transferred by way of a printer (not shown). In this regard, rolled medium 16 can comprise a thermal donor material that carries image forming materials including but not limited to dyes, pigments, inks, other colorants and/or protective materials that can be transferred from the donor onto a receiver by the application of force, energy, or other well known means. Medium 38 can also comprise receiver mediums that are adapted to receive dyes, pigments, inks, or other colorants from a donor medium or to receive inks or other materials from an inkjet, or contact printer. Medium 38 can also be of a type that is adapted to create contrast patterns when heat and/or other forms of energy are supplied thereto so that a thermal or other printer can record images thereon without applying a material such as a material from the donor medium or an ink. Medium 38 can also comprise other forms of receiver type mediums such as films, fabrics, papers and the like.

Figure 3:
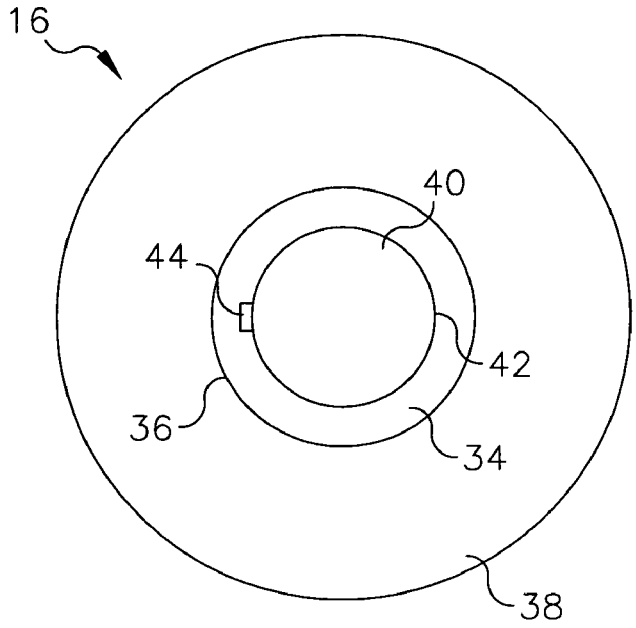
FIG. 3 illustrates an end view of a leading edge side of a rolled medium.
Figure 4:
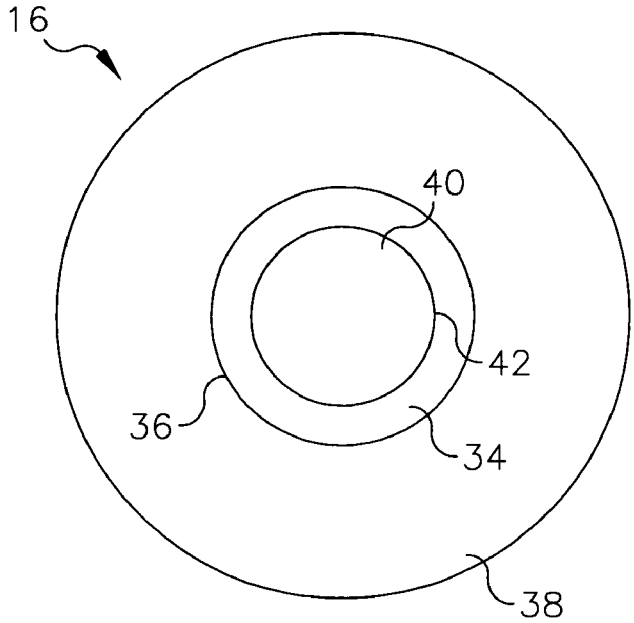
FIG. 4 illustrates another end view of a trailing edge side of a rolled medium.

In the embodiment of rolled medium 16 shown in FIGS. 2-4, cylindrical core 34 has an inner chamber 40 that comprises an inner wall portion 42. Inner wall portion 42 is sized and shaped to conform, generally, to the size and shape of drive surface 12 of cylindrical mandrel 14 so that drive surface 12 and inner wall portion 42 engage to cause rolled medium 16 and any medium 38 thereon to rotate generally in concert when holder 10 is installed in a printer and caused to rotate. As is further illustrated in FIG. 3, in this embodiment, inner wall portion 42 has one or more optional notch 44 therein that is adapted to engage one or more co-designed optional drive lugs 46 on drive surface 12 so that drive surface 12 and rolled medium 16 can rotate at a common rate.

As is also shown in FIGS. 1 and 2, a retaining surface 50 is provided proximate to load end 30 of drive surface 12. Retaining surface 50 is separated from stop surface 32 at a distance that is generally consistent with the anticipated width of rolled medium 16. Retaining surface 50 is movable between a first position where retaining surface 50 projects above drive surface 12 and a second position where retaining surface 50 does not project above drive surface 12.

Retaining surface 50 is biased to move from the second position to the first position by a resilient biasing member 52. Biasing member 52 is elastically deformable from an initial state to a set of deformed states whenever retaining surface 50 is driven from the first position to the second position. As this occurs, biasing member 52 stores potential energy. When retaining surface 50 is permitted to return, even partially, toward the first position, biasing member 52 releases the stored potential energy to urge retaining surface 50 to move toward the first position. This brings retaining surface 50 into contact with rolled medium 16 such as by contacting cylindrical inner core 34. While biasing member 52 continues to drive retaining surface 50 toward the first position, retaining surface 50 is moved in a direction that is generally normal to drive surface 12. However, the shape of retaining surface 50 translates a portion of the force urging retaining surface 50 in this direction into a force that urges inner core 34 toward stop end 20. Typically, such a shape can comprise an arcurated, slanted, sloped or contoured shape adapted to translate force in one direction into a vector of the initial direction and a direction that drives rolled medium 16 toward stop surface 32.

Figure 5:
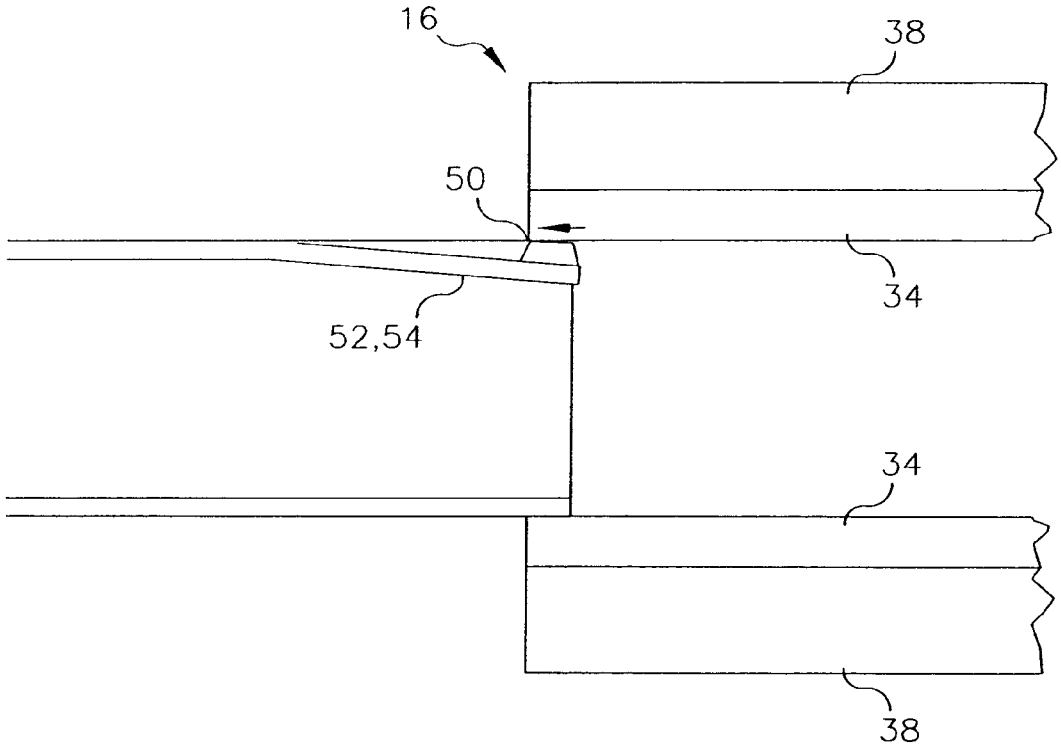
FIG. 5 illustrates a holder with a retaining surface at a second position.
Figure 6:
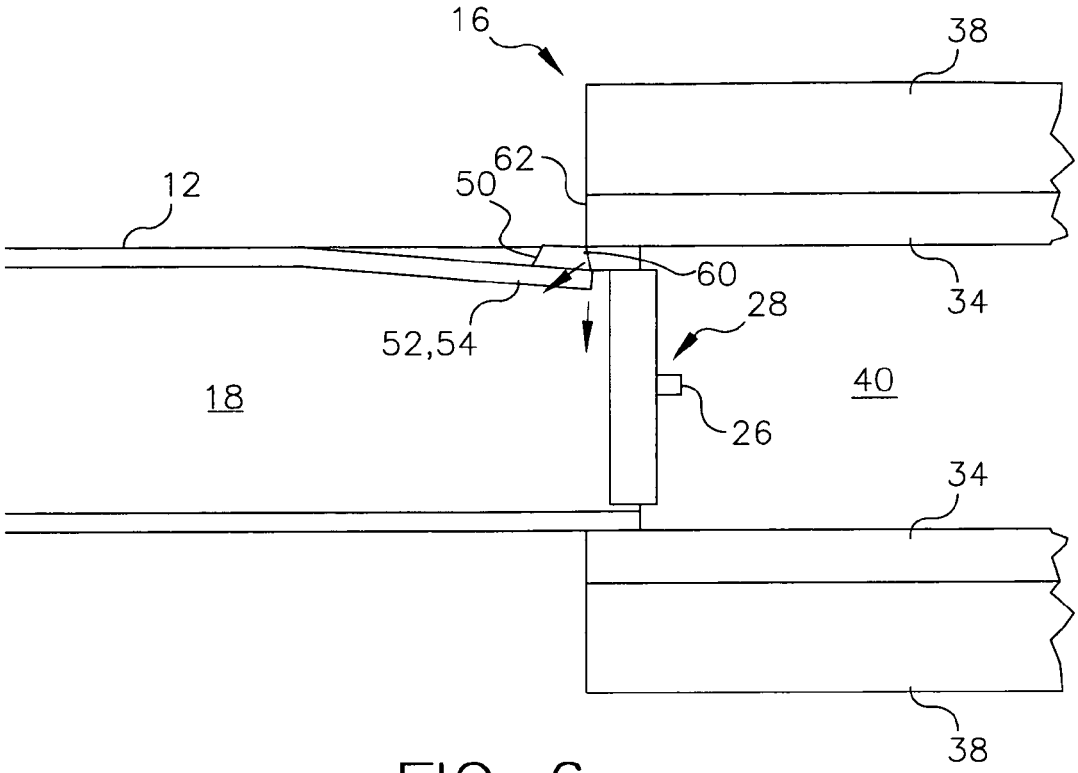
FIG. 6 illustrates a first portion of a loading process for loading rolled medium onto drive.
Figure 7:
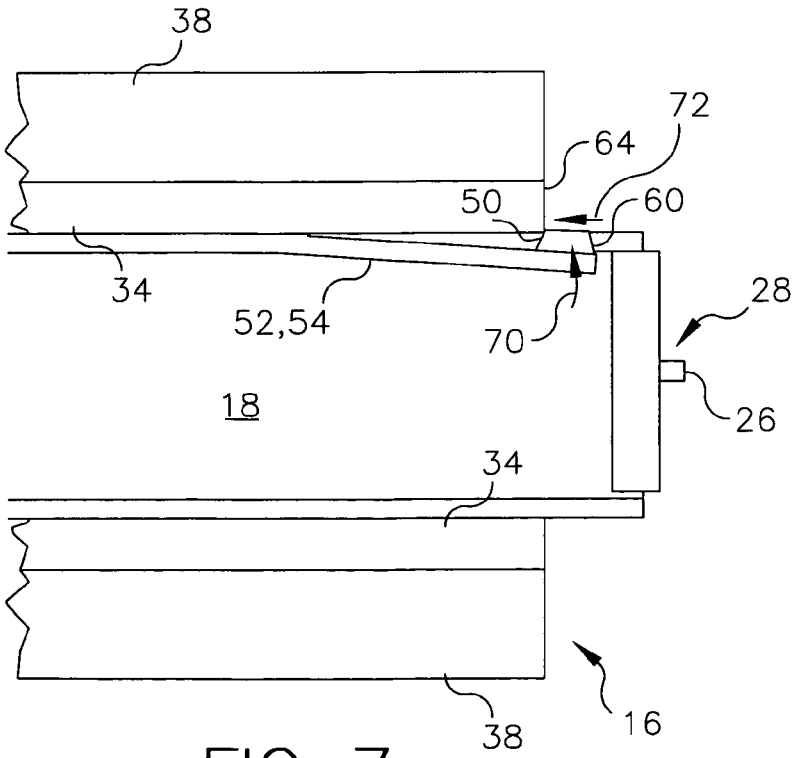
FIG. 7 illustrates a loading process as the rolled medium approaches a stop surface.

A detailed example of a loading process for the holder of FIGS. 1-4 will now be described with reference to FIGS. 5-7 which illustrate the interaction of retaining surface 50, biasing member 52 and rolled medium 16. In the embodiment of FIGS. 1-7, one embodiment of biasing member 52 is shown as a spring finger 54 that is integrally formed on drive surface 12 and that has retaining surface 50 provided thereon. To install a rolled medium 16, spring finger 54 is moved against its bias from the first position illustrated in FIGS. 1 and 2 toward a second position shown in FIG. 5 at which retaining surface 50 is positioned below drive surface 12. This allows any rolled medium 16 that is currently on drive surface 12 to be removed without interference from retaining surface 50 and also allows another rolled medium 16 to the inserted on to drive surface 12 without interference from retaining surface 50. Such deflection can be manually induced or mechanically induced, for example by inserting an appropriate tool within inner chamber 40.

In the embodiment of FIGS. 1-7, retaining surface 50 is adapted to facilitate such deflection during a first portion of a loading operation. As is illustrated in FIG. 6, in this embodiment, retaining surface 50 has a tapered loading portion 60 directed towards load end 30. Tapered loading portion 60 is shaped so that as a rolled medium 16 is loaded onto drive surface 12 from load end 30 and is advanced toward stop end 20, contact between a leading edge 62 of advancing rolled medium 16 and tapered loading portion 60 is translated into forces indicated by arrows in FIG. 6 urging retaining surface 50 to the second position so that rolled medium 16 can be loaded onto drive surface 12.

As leading edge 62 of inner core 34 or some other portion of rolled medium 16 contacts stop end 20, a trailing edge 64 of inner core 34 begins to confront retaining surface 50. This allows spring finger 54 to drive retaining surface 50 toward the first position. As rolled medium 16 is advanced along drive surface 12 toward stop surface 32, a trailing edge 64 of inner core 34 engages retaining surface 50. This prevents spring finger 54 from driving retaining surface 50 to the first position. As is shown in FIG. 7, the tapered sloping shape of retaining surface 50 translates such motion of retaining surface 50 in a direction 70 that is generally outward of drive surface 12 so that at least a part of the energy urging movement in direction 70 becomes a force that is applied against inner core 34 in a direction 72 that urges inner core 34 against stop surface 32 to position rolled medium 16. As illustrated, in FIG. 7 this occurs at a point where spring finger 54 has not returned retaining surface 50 to the first position.

It will be appreciated that this arrangement provides an initial advantage in helping to ensure that initial placement of rolled medium 16 on drive surface 12 is appropriate and that it also provides a further advantage after loading. Specifically, it will be appreciated that any forces that may be encountered during operation that tend to urge rolled medium 16 toward load end 30 and away from stop surface 32 will be resisted by the biasing force applied by resilient biasing member 52 such as spring finger 54 through retaining surface 50 to provide a dynamic adjustment system.

Figure 8:
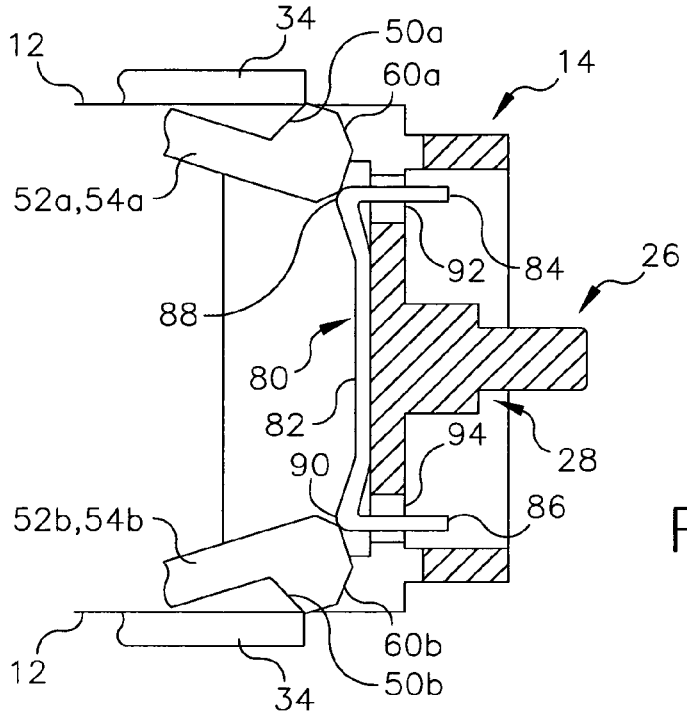
FIG. 8 illustrates an optional warning system in a warning condition.
Figure 9:
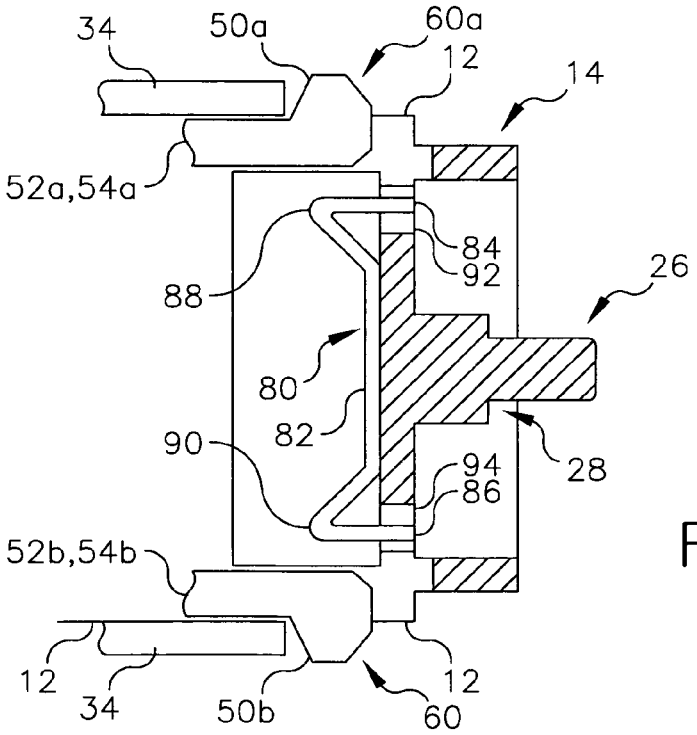
FIG. 9 illustrates the optional warning system of FIG. 8 in a non-warning condition.

FIGS. 8 and 9 show another embodiment of the holder 10 of the present invention. In this embodiment, holder 10 has two retaining surfaces 50*a* and 50*b* and two resilient biasing members 52*a* and 52*b* illustrated as two spring fingers 54*a* and 54*b* located on opposite sides of drive surface 12. It will be appreciated that in other embodiments, more than two retaining surfaces and resilient biasing members can be applied.

As is also shown in FIGS. 8 and 9, holder 10 is further adapted to provide a user with a warning signal that indicates the status of loading of a rolled medium 16 on the holder 10. In this embodiment, a warning flag 80 is shown fixed to a load end cap 28. Warning flag 80 comprises a center portion 82 joined to load end cap 28. Center portion 82 is flanked by two flag projections 84 and 86 extending away from load end cap 28. Flag projections 84 and 86 are associated with deflection surfaces 88 and 90 respectively. Warning flag 80 is elastically deformable in response to pressure applied against deflection surfaces 88 and 90 by movement of one of retaining surfaces 50*a* and 50*b*, resilient biasing members 52*a* and 52*b*, (shown as spring fingers 54*a* and 54*b*) tapered loading portion 60*a* and 60*b* during movement of resilient biasing members 52 between the first position and the second position. Warning flag 80 is shaped so that elastic deformation of the warning flag caused by contact with deflection surface 88 or 90 causes flag projection 84 or flag projection 86, respectively, to move to a position indicating the extent of such contact which in turn is indication of the extent to which retaining surface 50 has moved away from the second position. As shown in FIGS. 8 and 9 such projection causes flag projections 84 and 86 to extend outwardly from openings 92 and 94 in load end cap 28. Such a warning flag 80 can be adapted to provide flag projections 84 and 86 that are movable between a warning position indicating that retaining surface 50 is not in a position for holding rolled medium 16 against stop surface 32, and a position indicating that the retaining surface 50 is in a position for holding rolled medium 16 against the stop surface 32.

It will be appreciated that while the above embodiments have illustrated a resilient biasing member 52 comprising a spring finger 54, biasing member 52 can include other embodiments. For example, in other embodiments biasing member 52 can comprise at least one of a coil spring, a torsion spring, an air spring, a fluid spring, a combination of magnetic materials, a leaf spring, foams, fabrics or other materials that can be used to perform the function ascribed to resilient biasing member 52.

The invention has been described in detail with particular reference to certain preferred embodiments thereof, but it will be understood that variations and modifications can be effected within the spirit and scope of the invention.

PARTS LIST

| | |
|---|---|
| 10 | holder |
| 12 | drive surface |
| 14 | cylindrical mandrel |
| 16 | rolled medium |
| 18 | chamber |
| 20 | stop end |
| 22 | drive end cap |
| 23 | assembly drive gear |
| 24 | stop end axle |
| 26 | load end axle |
| 28 | load end cap |
| 30 | load end |
| 32 | stop surface |
| 34 | cylindrical inner core |
| 36 | outer surface |
| 38 | medium |
| 40 | inner chamber |
| 42 | inner wall portion |
| 44 | notch |
| 46 | drive lugs |
| 50 | retaining surface |
| 50a | retaining surface |
| 50b | retaining surface |
| 52 | resilient biasing member |
| 52a | resilient biasing member |
| 52b | resilient biasing member |
| 54 | spring finger |
| 54a | spring finger |
| 54b | spring finger |
| 60 | loading portion |
| 60a | loading portion |
| 60b | loading portion |
| 62 | leading edge |
| 64 | trailing edge |
| 70 | direction |
| 72 | direction |
| 80 | warning flag |
| 82 | center portion |
| 84 | flag projection |
| 86 | flag projection |
| 88 | deflection surface |
| 90 | deflection surface |
| 92 | openings |
| 94 | openings |

The invention claimed is:

1. A holder for rolled medium, the holder comprising:

a mandrel having a drive surface adapted to receive the rolled medium and further adapted to be rotated so that an amount of rolled medium on the drive surface can be unrolled therefrom;

a stop located on a stop end of the drive surface;

a retaining surface located on a load end of the drive surface and separated from the stop so that a rolled medium can be disposed therebetween, with the retaining surface being movable between a first position where the retaining surface projects above the drive surface and a second position where the retaining surface does not project above the drive surface; and a resilient biasing structure joined to the retaining surface and being elastically deformable with the biasing structure storing potential energy when the retaining surface is driven to the second position and releasing the stored potential energy to urge the retaining surface to move to the first position;

wherein said retaining surface is positioned to engage a rolled medium positioned on the drive surface at a position between the first position and the second position and is shaped to transfer a portion of the stored potential energy in the resilient biasing structure to drive the rolled media toward the stop.

2. The holder of claim 1, wherein the retaining surface has a tapered loading portion directed towards the load end, with the tapered loading portion being shaped so that as a rolled medium is loaded onto the mandrel from the load end and advanced toward the stop end, contact between a leading edge of the advancing rolled medium and said tapered edge is translated into a force urging the retaining surface to the second position so that the rolled medium can be loaded onto the mandrel.

3. The holder of claim 1, wherein said mandrel comprises a drive surface and drive end cap joined to the drive surface at the stop end and wherein said drive end cap provides said stop.

4. The holder of claim 1, wherein said mandrel comprises a drive surface and load end cap adapted to be joined to the load end, said load end cap being adapted to permit movement of the retaining surface between the first and second positions.

5. The holder of claim 1, wherein the retaining surface and the stop are separated by a distance that is at least equal to the width of the rolled medium.

6. The holder of claim 1, wherein the resilient biasing structure comprises at least one of a coil spring, a torsion spring, an air spring, a fluid spring, a combination of magnetic materials, a leaf spring, resilient foams, resilient fabrics, resilient plastics, resilient metals and resilient organic materials.

7. The holder of claim 1, wherein the mandrel and the drive surface are cylindrical.

8. A holder for rolled medium, the holder comprising:

a mandrel having a drive surface adapted to receive the rolled medium and further adapted to be rotated so that an amount of rolled medium on the drive surface can be unrolled therefrom;

a stop located on a stop end of the drive surface;

a retaining surface located on a load end of the drive surface and separated from the stop so that a rolled medium can be disposed therebetween, with the retaining surface being movable between a first position where the retaining surface projects above the drive surface and a second position where the retaining surface does not project above the drive surface; and a resilient biasing structure joined to the retaining surface and being elastically deformable with the biasing structure storing potential energy when the retaining surface is driven to the second position and releasing the stored potential energy to urge the retaining surface to move to the first position;

wherein said retaining surface is positioned to engage a rolled medium positioned on the drive surface at a position between the first position and the second position and is shaped to transfer a portion of the stored potential energy in the resilient biasing structure to drive the rolled media toward the stop; and further comprising a flag member joined to the mandrel at the load end, having a deflection surface and flag projection extending away from the mandrel joined to the deflection surface for movement therewith, said flag member being elastically deformable in response to pressure applied against the deflection surface by movement of at least one of the retaining surface and the resilient biasing member as the retaining surface is moved from the first position to the second position, wherein elastic deformation of the flag member cause the flag projection to move to a position indicating the extent to which the spring finger is separated from the first position.

9. The holder of claim 8, wherein said flag projection is movable between a warning position indicating that the retaining surface is not in a position for holding the rolled medium against the stop, and a position indicating that the retaining surface is in a position for holding the rolled medium against the stop.

10. The holder of claim 8, wherein said mandrel comprises a cylindrical drive surface.

11. The holder of claim 8, wherein said mandrel comprises a segmented drive surface.

12. A holder for rolled media, the holder comprising:

a mandrel defining a drive surface, said drive surface having a spring finger formed on said drive surface including at a load edge thereof with said spring finger having a retaining surface extending radially outward from the drive surface when the spring finger positions the drive surface in a first position;

said spring finger being elastically deformable to move the retaining surface from said first position to a second position wherein the retaining surface is positioned so that it does not extend radially outward from the drive surface and with said spring finger further being biased to move the retaining surface toward the first position; and a stop at a stop end of the drive surface to block rolled media on the drive surface from lateral movement along the mandrel toward the stop end;

wherein the retaining surface is defined so that when said rolled media is loaded on the mandrel to a position proximate to the stop, said retaining surface engages said rolled media with said spring finger at a position between the first position and the second position, so that a portion of the force biasing said retaining surface from the second position to the first position is applied to drive the rolled media toward the stop.

13. The holder of claim 12, wherein the retaining surface has a tapered loading portion directed towards the load end, with the tapered loading portion being shaped so that as a rolled medium is loaded onto the mandrel from the load end, said rolled medium drives the loading portion to move the retaining surface against the bias of the second position so that the rolled medium can be loaded onto the mandrel.

14. The holder of claim 12, wherein said mandrel comprises a cylindrical drive surface.

15. The holder of claim 12, wherein said mandrel comprises a segmented drive surface.

16. The holder of claim 12, wherein said mandrel comprises a drive surface and drive end cap having said stop joined to the drive surface.

17. The holder of claim 12, wherein the retaining surface and the stop are separated by a distance that is at least equal to the width of the rolled medium.

18. The holder of claim 12, wherein the mandrel and the drive surface are cylindrical.

19. A holder for rolled media, the holder comprising:

a mandrel defining a drive surface, said drive surface having a spring finger formed at a load edge thereof with said spring finger having a retaining surface extending outwardly from the drive surface when the spring finger positions the drive surface in a first position;

said spring finger being elastically deformable to move the retaining surface from said first position to a second position wherein the retaining surface is positioned so that it does not extend outwardly from the drive surface and with said spring finger further being biased to move the retaining surface toward the first position; and a stop at a stop end of the drive surface to block rolled media on the drive surface from lateral movement along the mandrel toward the stop end;

wherein the retaining surface is defined so that when said rolled media is loaded on the mandrel to a position proximate to the stop, said retaining surface engages said rolled media with said spring finger at a position between the first position and the second position, so that a portion of the force biasing said retaining surface from the second position to the first position is applied to drive the rolled media toward the stop; and further comprising a flag member joined to the mandrel at the load end, having a deflection surface adapted to engage an inside spring finger contact surface, said flag member having a flag projection extending away from the mandrel, said flag member being elastically deformable in response to pressure applied against the deflection surface by movement of the spring finger as the spring finger moves between the first position to the second position, wherein elastic deformation of the flag member cause the flag projection to move to a position indicating the extent to which the retaining surface is separated from the first position.

20. The holder of claim 19, wherein said flag projection is movable between a warning position indicating that the retaining surface is not in a position for holding the rolled medium against the stop, and a position indicating that the retaining surface is in a position for holding the rolled medium against the stop.

21. A holder for a rolled medium comprising:

a rolled medium drive surface for receiving the rolled medium;

a stop means at a first end of the rolled medium drive surface;

a retaining means at a second end of the drive surface, said retaining means separated from the stop means by a distance defined by a width of the rolled medium, said retaining means being movable between a first position where the retaining means projects above the drive surface and a second position where the retaining means does not project above the contact surface; and a biasing means for biasing the retaining means from the second position to the first position, wherein the retaining means has a translation means for converting the biasing from the biasing means into a force applied to urge the rolled medium toward the stop means.

22. The holder of claim 19, wherein the drive surface is cylindrical.

23. A holder for a rolled medium comprising:

a rolled medium drive surface for receiving the rolled medium;

a stop means at a first end of the rolled medium drive surface;

a retaining means at a second end of the drive surface, said retaining means separated from the stop means by a distance defined by a width of the rolled medium, said retaining means being movable between a first position where the retaining means projects above the drive surface and a second position where the retaining means does not project above the contact surface; and a biasing means for biasing the retaining means from the second position to the first position, wherein the retaining means has a translation means for converting the biasing from the biasing means into a force applied to urge the rolled medium toward the stop means; and further comprising a flag means for providing a warning when the retaining means is not positioned to drive the rolled medium against the stop.

* * * * *